US007416076B2

(12) United States Patent
Barton et al.

(10) Patent No.: US 7,416,076 B2
(45) Date of Patent: Aug. 26, 2008

(54) APPARATUS AND METHOD FOR PACKAGING AND SHIPPING OF HIGH EXPLOSIVE CONTENT COMPONENTS

(75) Inventors: John A. Barton, Arlington, TX (US); Antony F. Grattan, Mansfield, TX (US); Thomas J. Wuensche, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 616 days.

(21) Appl. No.: 10/755,728

(22) Filed: Jan. 12, 2004

(65) Prior Publication Data

US 2005/0150781 A1 Jul. 14, 2005

(51) Int. Cl.
*F42B 39/00* (2006.01)

(52) U.S. Cl. ..... 206/3; 206/593

(58) Field of Classification Search ..... 206/3, 206/593, 594, 523, 585, 522, 521; 89/1.14
See application file for complete search history.

(56) References Cited

U.S. PATENT DOCUMENTS

| | | | | | |
|---|---|---|---|---|---|
| 3,731,585 | A * | 5/1973 | Demberg et al. | ..... | 86/1.1 |
| 3,757,933 | A * | 9/1973 | Banta | ..... | 206/3 |
| 4,055,247 | A * | 10/1977 | Benedick et al. | ..... | 206/3 |
| 4,440,296 | A * | 4/1984 | Howe et al. | ..... | 206/3 |
| 4,817,531 | A * | 4/1989 | Walker et al. | ..... | 102/306 |
| 5,097,945 | A * | 3/1992 | Brooks | ..... | 206/3 |
| 5,494,152 | A * | 2/1996 | Sobczak et al. | ..... | 206/3 |
| 6,347,700 | B1 * | 2/2002 | Redfield et al. | ..... | 206/3 |
| 6,454,085 | B1 * | 9/2002 | Barker | ..... | 206/3 |
| 6,536,654 | B2 * | 3/2003 | Reynolds et al. | ..... | 229/103.11 |
| 6,792,866 | B2 * | 9/2004 | Grattan | ..... | 102/310 |
| 2003/0111220 | A1 * | 6/2003 | Bell | ..... | 166/55 |

FOREIGN PATENT DOCUMENTS

| | | |
|---|---|---|
| DE | 3805478 A1 | 8/1989 |
| EP | 0 490 766 A2 | 6/1992 |
| EP | 1 225 417 A2 | 7/2002 |

OTHER PUBLICATIONS

International Search Report and Written Opinion, PCT/US2005/000513, Feb. 3, 2006, 14 pgs.

* cited by examiner

*Primary Examiner*—Mickey Yu
*Assistant Examiner*—Steven A. Reynolds
(74) *Attorney, Agent, or Firm*—Michael W. Piper

(57) ABSTRACT

A system and method for a packaging system for the shipment of high explosive components is described. One or more explosive devices are positioned in a tubing assembly having opposed ends and a thick wall of relatively low-density fibrous material, e.g. rolled paper tube. An impact absorbing element is positioned at each end of the tube. The impact absorbing element may include an end cap positioned within each end of the tube, and a cushion formed of partial tubes and an end cap. The complete assembly is sized to fit and be held in position by a standard shipping container. Multiple perforating charges in a tubing assembly may face opposite sides of a charge divider. Shaped charges may have their concave openings filled with a jet interrupter, e.g. sand. Circular charges may include heat releasable fasteners, e.g. nylon screws, which allow the charges to separate in case of fire.

3 Claims, 7 Drawing Sheets

APPARATUS AND METHOD FOR PACKAGING AND SHIPPING OF HIGH EXPLOSIVE CONTENT COMPONENTS

FIELD OF THE INVENTION

The present invention is concerned with the packaging and shipment of high explosive content components and, more particularly, with a system and method for making and using a packaging system for the shipment of high explosive components.

BACKGROUND OF THE INVENTION

The shipment of explosives is carefully regulated by various government agencies, primarily for safety purposes. The regulations impose various levels of restrictions depending upon type of explosive, weight of individual explosive components, total weight in an individual package, relative positioning of multiple explosive components in a single package, types of packaging materials and other factors.

Commercial and private carriers are concerned with and regulate the packaging and shipment of explosives. In order to ship explosives or components containing explosives, commercial and private carriers typically require a UN shipping classification that demonstrates that the packaging method for the explosives has been established as safe for highway and private or commercial aircraft conveyance. Typically, tests are conducted to determine the shipping classification of an explosive article and, particularly, the ability of the article and its packaging to prevent or contain multiple or mass detonation of the explosive. The more likely an article is to mass detonate other similar articles, the more restrictive and expensive it is to ship. Relatively higher explosive content explosives and explosive components have a greater tendency to mass detonate.

SUMMARY OF THE INVENTION

The embodiments disclosed herein provide apparatus for packaging and shipping quantities of explosive material that are substantially larger than quantities which could previously be shipped in compliance with regulations and testing requirements. These embodiments allow charges having 39 grams or more of explosive to be shipped in a single package, while meeting applicable regulations concerning mass detonation, fragmentation and safety in a fire.

An embodiment of the invention includes a tubing assembly having an interior space for holding an explosive device and having two open ends. One or more energy absorbing elements or cushions are positioned proximate each open end. The energy absorbing elements include a collapsible three-dimensional hollow structure positioned across the open ends.

In one embodiment, the energy absorbing element comprises a partial tube having a convex side proximate the tubing assembly open ends and a concave side proximate an interior wall of a shipping container. In another embodiment, the energy absorbing element includes an end cover positioned between the partial tube concave side and the interior wall of a shipping container.

In one embodiment, a divider assembly comprising a plurality of panels arranged in an interlocking matrix defining a plurality of compartments within said matrix is positioned within the shipping container. A tubing assembly with an explosive device may be carried in some or all of the compartments defined by the divider assembly.

In an embodiment for shipping perforating charges, the tubing assembly includes a thick walled relatively low density tubular element having an interior space for holding one or more pairs of charges. The charges in a pair may be positioned with their concave jet producing openings proximate each other and separated by a charge divider. End caps may be positioned within the open ends of the tubing assembly.

In an embodiment for shipping circular shaped charges, i.e. tubing cutters, the tubing assembly may include a first thick walled relatively low density tubular element having an interior space for holding one assembled tubing cutter and a second tubular element, e.g. a square cross section metal element, having an interior space for holding the first tubular element. Alternatively, the second tubular element may comprise a compartment in a divider assembly. In this embodiment, the energy absorbing elements may comprise a length of metal tubing, e.g. with a square cross section, carried in the second tubular element proximate each end of the first tubular element. A porous fragment catcher, e.g. foam rubber, may be included between each of the energy absorbing elements and the ends of the first tubular element.

In embodiments in which the explosive devices comprise shaped charges, jet interrupters may by positioned within the concave jet producing openings of the charges. In one embodiment, the jet interrupter is a granular incombustible material, e.g. sand.

In one embodiment, tubing cutter assemblies include connecting means that degrade at elevated temperature to allow the assembly housing to open. In some embodiments, the connecting means may be plastic snap rings or plastic bolts which hold the cutter assemblies together during normal operations, but which degrade, e.g. melt or burn, at high temperature and allow the tubing cutter assembly to separate.

BRIEF DESCRIPTION OF THE DRAWINGS

The invention, together with further advantages thereof, may best be understood by reference to the following description taken in conjunction with the accompanying drawings in which.

DETAILED DESCRIPTION

The invention relates to novel methods and apparatus for packaging explosives, and components containing explosives, for storage and shipping.

The multiple embodiments of the invention disclose several assemblies for packaging and shipping explosive material that allows for the shipment of explosive materials of a size equal to or greater than 39 grams by transportation methods that otherwise limit the size of explosive material shipped to 39 grams or to thresholds less than 39 grams, such as 22 grams. The use of the disclosed apparatus reduces the likelihood of sympathetic detonations of multiple explosive materials shipped in a single container in the event of an unplanned detonation of an individual explosive within the container. The use of the apparatus also reduces the likelihood of sympathetic detonations of multiple explosive materials shipped in separate containers in the event of an unplanned detonation of an individual explosive within one container.

Figure 1:
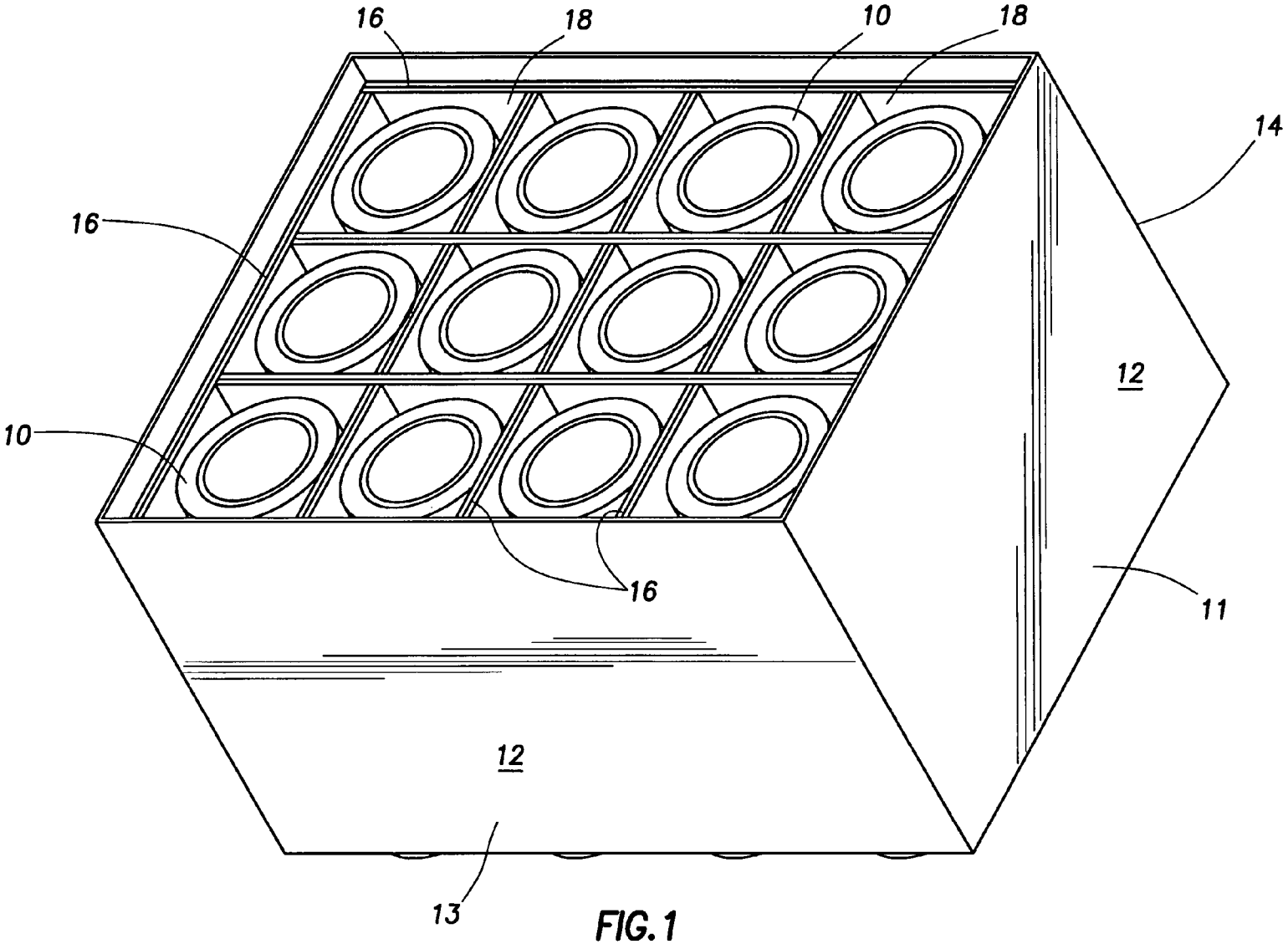
FIG. 1 is a perspective view of a portion of an outer container illustrating a laminated divider assembly and tubing assemblies.
Figure 2:
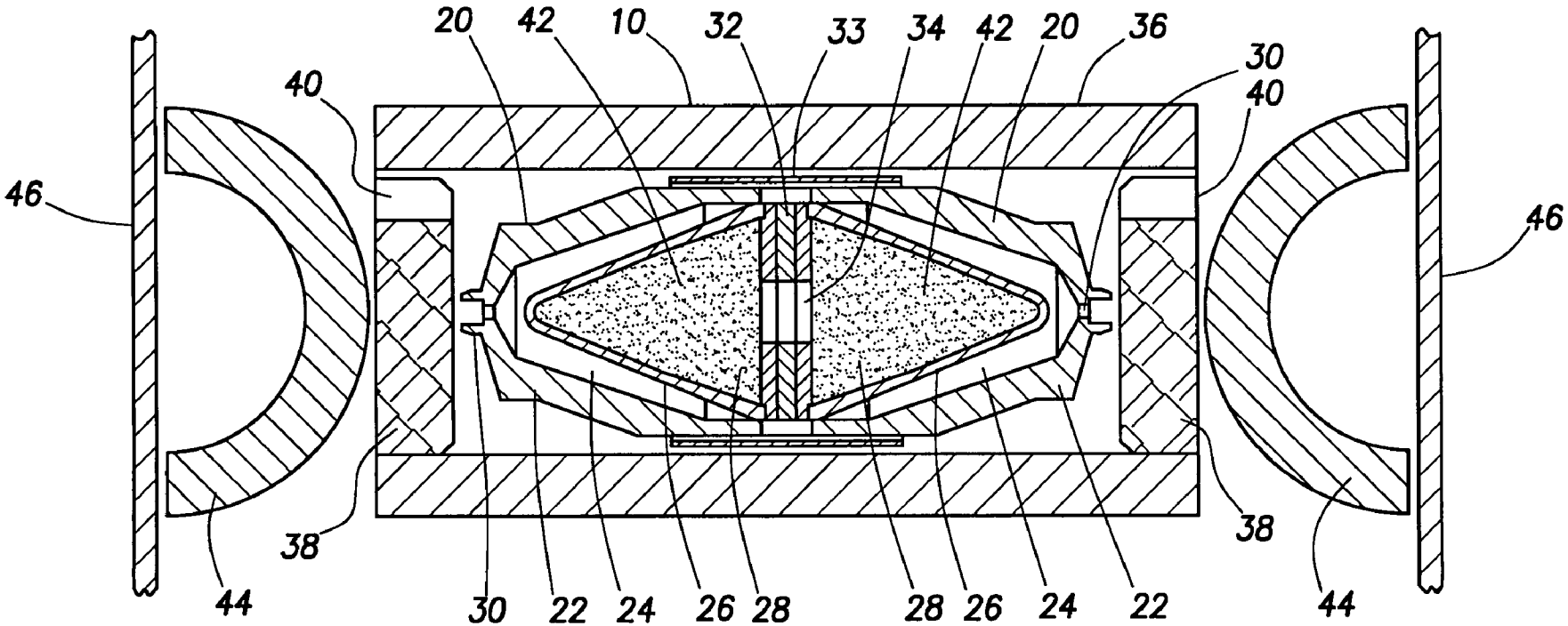
FIG. 2 is a cross sectional view of a tubing assembly illustrating the positioning of explosive components and energy absorbing elements relative to the tubing assembly.

FIG. 1 illustrates an embodiment in which a plurality, in this case twelve, of tubing assemblies 10 are positioned within the sides 12 of a conventional shipping container 14. The shipping container 14 may be a double corrugated cardboard box meeting UN regulations for shipment of hazardous materials. Such boxes typically have a wall thickness of about 0.25 inch and it is preferred that the wall thickness be at least about 0.2 inch. Each tubing assembly 10 may carry one or more explosive components. Details of the tubing assemblies 10 are shown in FIG. 2 and described below. In FIG. 1, the top and bottom of the container 14 are not shown to provide a clear view of the arrangement of the tubing assemblies 10. In this embodiment, the tubing assemblies 10 are held in their relative positions within the shipping container by a matrix of dividers 16. The dividers are slotted and interlocked to provide a plurality, in this case twelve, of square cross section elongated compartments 18 extending from near the top to near the bottom of the container 14. Each compartment 18 is sized to receive one of the tubing assemblies 10 and hold it in a preselected position within container 14. It is not necessary for every compartment 18 to carry a tubing assembly 10. In some embodiments it may be preferred to leave some compartments 18 empty to increase the space between tubing assemblies 10.

The dividers 16 may be made of a number of potential materials including various solid or composite materials such as various polymers or polymer blends, pulp products, or wood. One embodiment may use composite wood products (products containing wood plies, fibers, or particles) such as plywood, fiberboard, or particle board. A preferred embodiment may use a laminated material (a material incorporating at least two layers) such as laminated wood, cardboard, solid wood to which is attached a layer of cardboard or heavy paper, cardboard, or a laminate material comprising a layer of a puncture resistant material such as para-aramid fiber, e.g. that sold under the trademark Kevlar®. In FIG. 1, the dividers are made of a laminate of three layers of thin plywood separated by two layers of corrugated cardboard. This laminated structure was chosen to provide relatively hard or stiff layers, i.e. plywood, separated by relatively soft or compressible layers, i.e. corrugated cardboard.

FIG. 2 is a cross section of a tubing assembly 10 illustrating the arrangement of two explosive devices 20 within the tubing assembly and other packaging components. In this embodiment, the explosive devices 20 are big hole or deep penetration perforating shaped charges each having from 39 to 47 grams of explosive material, for example HMX, RDX, HNS or BRX. Each device 20 includes three approximately conical parts; a metal housing 22, a high explosive 24 and a metallic liner 26. Each device 20 has a concave opening 28 at one end from which a penetrating jet is formed upon detonation of the explosive 24. The opposite end 30 of each device is closed except for a small opening for receiving a detonating device, e.g. detonating cord, for firing the explosive 24.

In this embodiment, two explosive devices 20 are positioned with the output ends or concave openings 28 facing and adjacent each other. The devices 20 are separated by a charge shipping divider 32 of a thickness and density sufficient to isolate and reduce movement between two or more explosive components 20 and to assist in absorbing gaseous and solid by-products of a detonation of the explosive material 24 within the tubing assembly 10. The materials of construction for the charge shipping divider 32 may preferably include a laminated material such as plywood or solid wood such as pine to which is attached a layer of cardboard or heavy paper and/or a layer of puncture resistant material such as Kevlar to absorb energy of a detonation of high explosives and to reduce the velocity of any propelled fragments that may cause a sympathetic detonation of an adjacent explosive component. In various embodiments, the charge shipping divider 32 may be axially bored with an aperture 34, and may be about one and one-half inch thick or preferably within a range of about 0.7 inch to about 2.5 inch thick.

In this embodiment, the primary structural element of the tubing assembly 10 is a section of cylindrical tube 36 having an outer diameter of about four inches, an inner diameter of about 2.75 inches and a wall thickness of about five-eighth inch. It is preferred that the tube 36 have minimum material wall thickness of about 0.6 inch, or at least 0.5 inch, and a minimum inside diameter sufficient to accommodate the explosive components 20. The materials of construction for the tube 36 may be selected from low-density heavy paper or cardboard. In this embodiment, the tube 36 is a rolled paper tube. The material of the tubing assembly 10 should be of a thickness and density sufficient to assist in absorbing the gaseous and particulate by-products of a detonation of the explosive material 24 within the tubing assembly 10. Materials made of cellulose fibers, e.g. wood pulp, cotton, etc., have a desirable combination of relatively low density and sufficient strength to absorb energy upon detonation of a charge 20. In one embodiment, the outside diameter of the tubing assembly 10 is slightly greater than the shortest distance within the compartments 18 of the matrix of the divider 16 to provide a slight interference fit between the tubing assembly 10 and the divider assembly 16 to reduce or prevent the tubing assembly 10 from moving relative to the divider assembly 16 during shipping operations. In an alternative embodiment, the outside diameter of the tube assembly 10 is about the same as the shortest distance within the compartments 18 of the matrix of the divider 16.

In the embodiment of FIGS. 1 and 2, the tubing assembly 10 is assembled in a cylindrical tube 36, that is, it has a circular cross sectional shape. The tube 36 could have other cross sectional shapes, e.g. square, hexagonal or honeycomb, etc. The other shapes may have appropriate inside dimensions to hold the charges 20 in their interior spaces and may have exterior dimensions that fit conveniently within the compartments 18. For purposes of the present disclosure, the term tube or tubing is therefore intended to include hollow elongated elements having circular, square, hexagonal or other cross sectional shapes. With any of these shapes, the tubing defines an interior space for holding one or more explosive devices and has two open ends through which the explosive devices and other components may be loaded into the interior space.

In this embodiment, each end of the shipping tube 36 is closed by an end cap 38 of a thickness and density sufficient to assist in absorbing at least some of the gaseous and solid by-products of a detonation of the explosive material 24 within the shipping tube 36. The materials of construction for the end cap may preferably include a material such as plywood or heavy paper or cardboard or solid wood such as pine to which may be attached a layer of cardboard or heavy paper or a layer of a puncture resistant material such as Kevlar®. In one embodiment, the outside circumferential dimension of the end cap 38 is slightly greater than the inside diameter of the shipping tube 36 so as to create a slight interference fit when the end cap 38 is inserted into the shipping tube 36. In an alternative embodiment, the outside circumferential dimension of the end cap 38 is about the same as the inside diameter of the shipping tube 36. In this embodiment, a semicircular cut 40 has been made in the outer circumference of each end cap 38 to allow venting of gasses produced if an explosive 24 detonates or burns. The cuts 40 also provide a convenient way to remove the end caps from the tube 36, especially if the end caps 38 are size for an interference fit within the tube 36. In various embodiments, the end caps 38 may be about 0.75 inch thick or within a range of about 0.50 inch to about 1.5 inch thick.

In FIG. 2, the tube 36 is of sufficient length to hold two explosive devices 20, one charge divider 32 and two end caps 38. The tube may be longer if it is desired to carry more than two explosive devices 20. It is normally desirable to carry even numbers of the devices 20, with each pair facing each other and separated by a charge divider 32. Additional end caps 38 may be placed between adjacent pairs of devices 20. Thus a tubing assembly for two pairs of the devices 20 would use a tube 36 having sufficient length to hold four of the devices 20, two charge dividers 32 and three end caps 38.

In FIG. 2, a jet interrupter 42 comprised of a quantity of a granulated, incombustible material, such as sand, is disposed within the open ends of explosive devices 20. A purpose of the jet interrupter is to reduce or prevent the formation of a jet of the liner material 26 of the shaped-charge 20 in the event of detonation of the explosive 24 and thereby reduce or prevent the likelihood of a sympathetic detonation of other charges or explosive components within the tubing assembly 10 or penetration of the outer container 14. Testing using sand as the interrupter 42 resulted in no detectable jet formation. The jet interrupter may further serve as a desiccant to protect the shaped charge from degradation as a result of environment. The granulated material of the jet interrupter may allow a grain-to-grain contact of the jet interrupter material in the event of a detonation that serve to dissipate energy of the explosion and to reduce the velocity of any products of an explosion. Sand was used in this embodiment because it is readily available, inexpensive and presents no environmental problems when it is disposed on at a work site. Other incombustible granular materials suitable for use as a jet interrupter include fracturing beads commonly used in well treatments and often referred to as frac beads, ceramic beads, etc.

In this embodiment, a quantity of the interrupter material 42 is poured into the opening 28 of the shaped-charge 20 and the end of the shaped-charge assembly 20 is closed with a cover such as a paper sheet, polymer film, or other relatively thin sheet of material secured with a fastener such as tape, glue, or other fastening device or substance to prevent the jet interrupter material 42 from spilling from the end 28 of the shaped-charge assembly 20 during storage or shipping and to permit a non-explosive escape of gaseous products of combustion of an explosive. In FIG. 2 there is also illustrated a thin walled sleeve 33 which may be used to hold two explosive devices 20 and a charge divider 32 in their proper relative positions so that they may be loaded into the tube 36 as a unit. Use of the sleeve 33 facilitates proper loading of the interrupter material 42 and reduces the possible loss of the interrupter material 42 when the devices 20 are placed into the tube 36. In an alternate method of loading a particulate jet interrupter, the particulate material may be mixed with a small amount of a binding agent, e.g. an adhesive, and molded into a shape that will mate with the inner surface of the opening 28. The binding agent is preferably limited to an amount that lightly binds adjacent particles and does not fill open spaces to form a solid plug. Detonation of the explosive 24 should fluidize the lightly bound particles so that they will act like the loose sand used in successful testing. In another alternative embodiment, the jet interrupter may be contained within a flexible container or bag which allows the material to flow or move to conform to the shape of the area in which it is placed, while also reducing the possibility of the individual particles escaping the area.

As noted above, the jet interrupter 42 is believed to prevent creation of a jet by a perforating charge. That is, the jet is not allowed to begin. If the jet interrupter 42 is not used, a jet can be expected to start as the explosive 24 detonates, but the charge divider 32 will disrupt the jet to some extent as it leaves the device 20. While the jets formed by explosive devices 20 effectively penetrate dense materials such as steel and rock, we have found that the lower density fibrous materials used in the various embodiments disclosed herein disrupt the jet sufficiently to avoid sympathetic detonation of other charges and to avoid significant damage to materials outside the shipping container 14. For purposes of this disclosure the term interrupt is intended to mean preventing formation of or stopping formation of a jet at its normal starting point. The term disrupt or disruption is intended to mean interfering with or dispersing a jet which has already started or formed sufficiently that it does not perform its intended perforating or cutting action. The terms can be used somewhat interchangeably in the sense that interruption of a jet can be the same function as disrupting a jet at its point of origin.

FIG. 2 also illustrates two packaging cushion components for absorbing, attenuating and distributing kinetic energy of various fragments that result from detonation of one of the explosive devices 20. For example, upon detonation of one of the devices 20, the metal housings 20 move toward the end caps 38 and the housings 20 and end caps 38 tend to be thrown out the ends of the tube 36. In this embodiment, a partial tube 44 is positioned with its convex side adjacent each of the end caps 38. Each partial tube 44 may be one half of a tube 36, which has been cut or split lengthwise. A substantially flat end plate or cover 46 is positioned adjacent the concave side of each partial tube 44. The end covers 46 are preferably made of a relatively stiff or rigid material, for example nominal one-quarter inch thick plywood as was used in this embodiment. It is preferred that the end cover, if used, have a thickness of from about 0.2 inch to about 0.5 inch. The end covers 46 are positioned against an inner wall, e.g. top and bottom, of the container 14 of FIG. 1 when the shipping package is fully assembled and have the same length and width as the adjacent container 14 sides. If an explosive device 20 should detonate, materials thrown from the ends of the tube 36 will impact on the partial tubes 44 which will absorb energy as they deform or collapse. Forces acting on the partial tubes 44 will be spread out and transferred to the end covers 46. The stiffness of the end covers 46 will further distribute the forces and, due to increased surface area, quickly slow any moving parts. In an alternative embodiment, the end cover 46 may be incorporated into the side of the container 14 or may be a separate component independent of the container 14.

Figure 3:
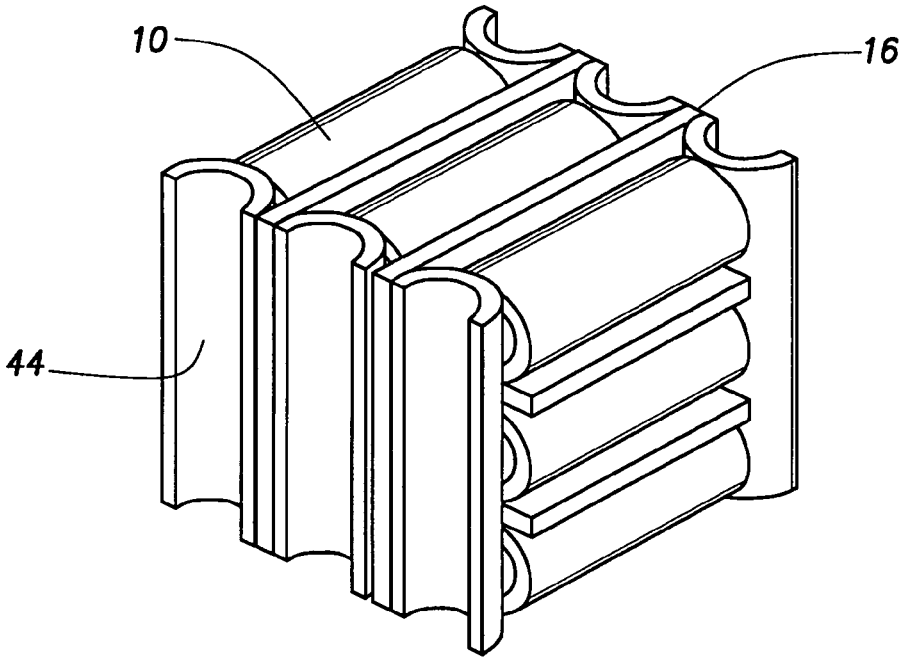
FIG. 3 is a perspective view of a plurality of tubing assemblies, a divider assembly and energy absorbing elements illustrating their relative positions when loaded into a shipping container.

FIG. 3 illustrates one assembly of packaging components that may be placed in an appropriately sized container 14. In FIG. 3, nine tubing assemblies 10 are stacked in a three by three arrangement separated by a matrix of dividers 16. The vertical dividers are longer than the horizontal dividers. A set of six partial tubes 44 is positioned across the ends of the tubing assemblies 10. Each partial tube is positioned across three of the tubing assemblies 10, and is partly held in position by the vertical dividers 16. The assembly of FIG. 3 may be placed into an appropriately sized container 14, which then may be closed and taped shut. If desired, a pair of end covers 46 may be placed between the partial tubes 44 and the inside walls of the container 14. In some packaging arrangements, the walls of the shipping container 14 may have sufficient strength so that end covers 46 would not provide any benefit. For example, if the partial tubes 44 are positioned adjacent the top and bottom of the container 14 which are formed by double flaps folded and taped in position, the resulting double thickness of double corrugated cardboard may effectively absorb and spread the impact forces. Additional dividers 16 may be placed around the stack of tubing assemblies 10 and against the remaining walls of the container 14.

Figure 4:
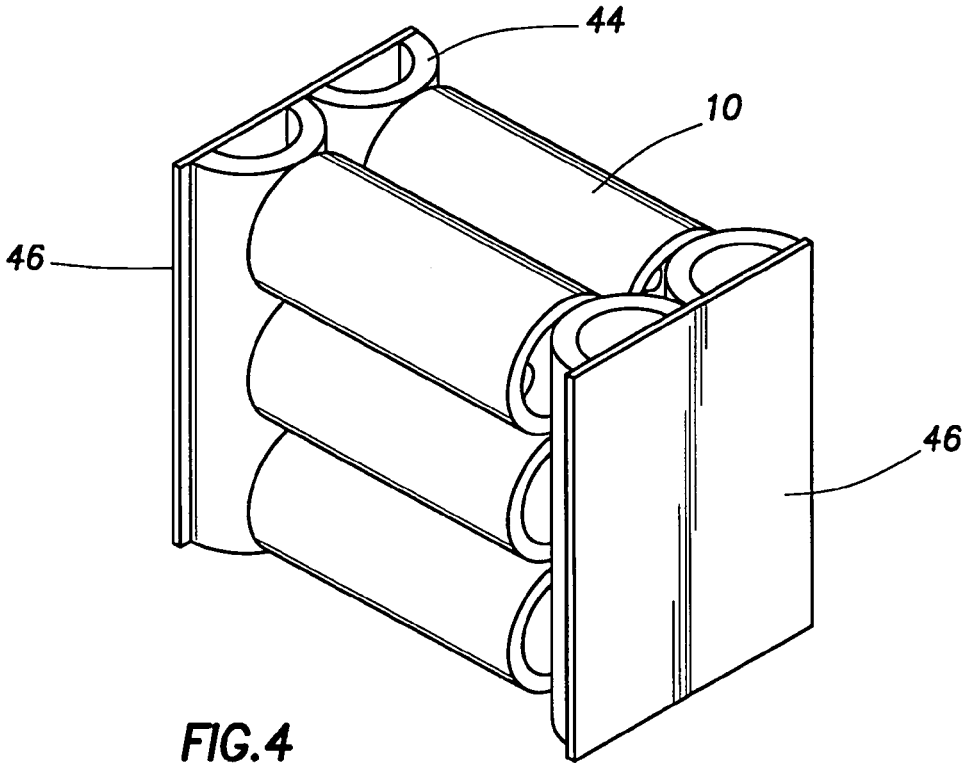
FIG. 4 is a perspective view of an alternative arrangement of a plurality of tubing assemblies and energy absorbing elements illustrating their relative positions when loaded into a shipping container.

FIG. 4 illustrates another assembly of packaging components that may be placed in an appropriately sized container 14. In FIG. 3, six tubing assemblies 10 are stacked in a three high by two wide arrangement. No dividers 16 are used in this assembly. Two partial tubes 44 are positioned at each end of the tubing assemblies 10, each extending across three of the tubing assemblies 10. A pair of end covers 46 are positioned adjacent the concave sides of the partial tubes 44. It is preferred for the partial tubes 44 to be as long as possible to more effectively absorb energy and spread forces. In FIG. 4, the partial tubes 44 could be cut to a length that would extend across only two tubing assemblies 10 and three of such partial tubes 44 could be positioned horizontally instead of vertically. But the shorter partial tubes 44 would each have less mass and less ability to spread forces than the longer partial tubes shown in FIG. 4.

As noted above, the tube 36 may have various cross-sections and need not have the circular cross-section shown in these embodiments. In similar fashion, the partial tubes 44 may be parts of tubing having square, hexagonal, etc. cross sections. Any of these shapes provides a three dimensional element which encloses an open space and has walls which may deform or collapse into the open space while absorbing energy and slowing any fragments which have impacted the energy absorbing elements. The partial tubes could be made of other materials, such as metal, e.g. mild steel, which can bend and absorb energy when hit by fragments. If a metal partial tube were used, it would be preferred to also use a relative stiff end plate 46 which would resist cutting by edges of the partial tube. The partial tubes 44 do not necessarily need to be one half of a complete tube. For example, a complete tube could be cut into three partial tubes if desired. In alternative embodiments, the enclosed open space could be filled with a relatively deformable or alternatively a relative brittle material such as various foams or other packing materials to absorb additional energy while still allowing freedom of the tubes to collapse and deform.

The partial tubes described above have a shape providing a convex side and a concave side, having a convex side disposed adjacent to an end cap 38 and a concave side disposed adjacent to an end cover 46. In an alternate embodiment, the concave side may be disposed adjacent to the end cap 38 and the convex side disposed adjacent to the end cover 46. In an alternate embodiment, there may be a plurality of partial tubes with alternating convex and concave sides disposed adjacent to the end cap 38 or the partial tubes may be coupled to form a larger uniform piece with a wave type structure of either repeated convex or concave profiles or alternating convex and concave profiles.

Testing of the embodiments shown in FIGS. 1-4 has demonstrated that upon detonation of one of the explosive devices 20 having 39 grams of explosive, all of these embodiments prevent sympathetic detonation of explosive devices in the same tubing assembly 10, in the same container 14 or in an adjacent container 14. The adjacent device 20 may have its explosive material burned away, but not in a detonation which would form a jet. The tube 36 surrounding the detonated device 20 is destroyed and adjacent dividers 16 and tubes 36 are damaged. If dividers 16 are not used, the adjacent tubes 36 are more severely damaged. The housings 22 of adjacent explosive devices 20 tend to be bent out of round but show no indication of impact by hard fragments and the explosive 24 remains intact, that is not detonated or burned.

In an alternate embodiment, the tubing assemblies 10 may be loaded only into alternate chambers 18 in the matrix shown in FIG. 1 so that the closest assembly 10 is in a diagonally separated chamber 18. This arrangement increases the distance between the adjacent assemblies 10 and effectively places two dividers 16 between the adjacent assemblies 10. This arrangement may be preferred for larger charges having up to 56 grams of explosive. This same diagonal spacing may be achieved in the FIG. 4 embodiment, by leaving alternate tubes 36 empty so that they act merely as packing elements for properly positioning the loaded assemblies 10 and provide additional distance and energy absorbing material between the loaded assemblies 10.

In the above-described embodiments, the explosive charges 4 are individual shaped charges of the type typically used for forming perforations in wells. A large number of these charges may be assembled into a perforating gun at a well site and fired essentially simultaneously in a well to form a plurality of perforations. Another type of explosive charge often used in wells is circular shaped charges used for cutting tubing or casing and therefore usually referred to as tubing cutters or casing cutters. Normal practice is for tubing cutters to be completely assembled at the factory and shipped to the well site for use. The following embodiments provide packing systems suitable for shipping circular shaped charge assemblies or circular charge cartridges or half cartridges.

Figure 5:
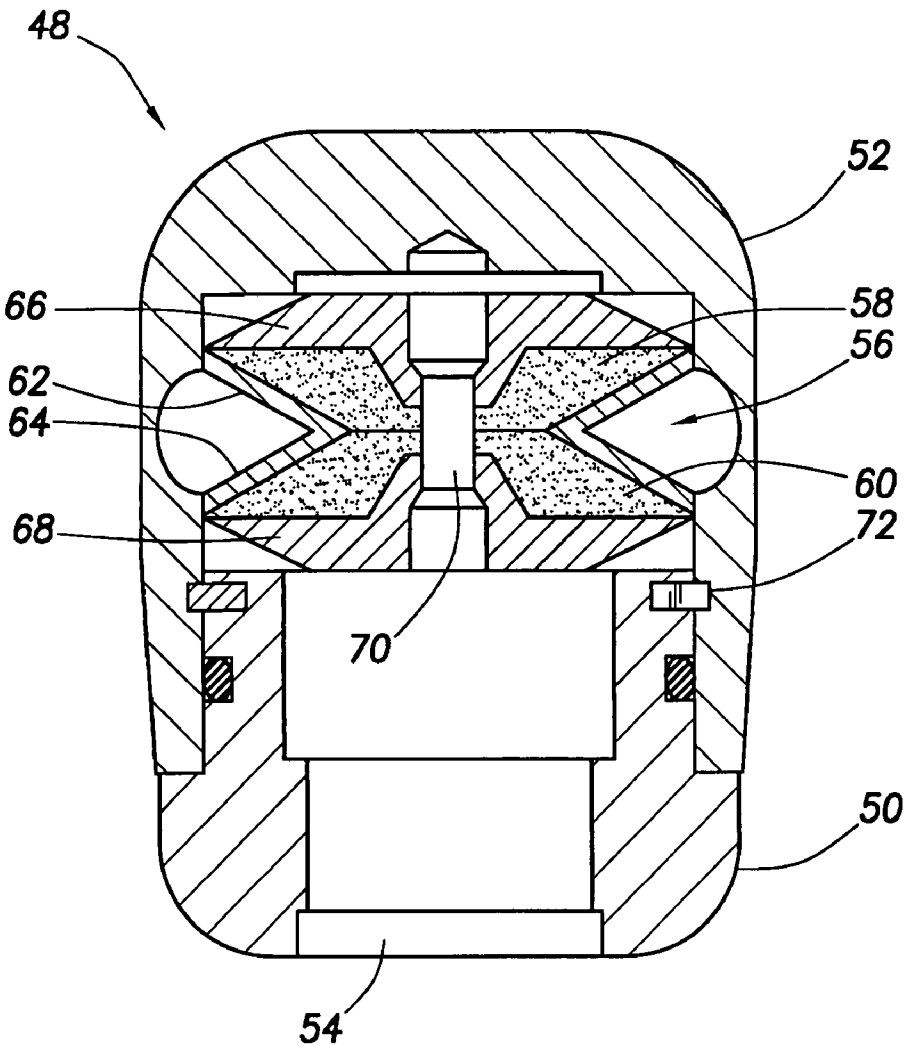
FIG. 5 is a cross sectional view of a circular explosive assembly which may be shipped in another embodiment of the invention.

FIG. 5 is a cross sectional view of an assembled tubing cutter 48 which may be shipped in a packing system according to embodiments shown in FIGS. 8-10 and described in detail below. The cutter 48 is assembled in a housing having two main structural components, a base portion 50 and a cap 52. The base 50 includes a threaded opening 54 into which a firing assembly may be inserted for lowering cutter 48 into a well and firing the cutter. Within the housing 50, 52, is a circular shaped charge cartridge 56. The Cartridge 56 includes two circular half charges 58 and 60, two circular half metallic liners 62 and 64 and two retainers or backing plates 66 and 68. A booster charge 70 may be positioned in the center of the charge cartridge 56 or may be inserted at the work site.

Figure 6:
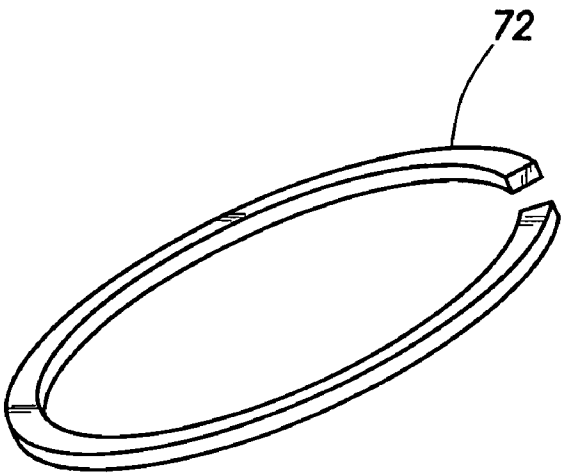
FIG. 6 is a perspective view of a snap ring used to assemble the circular explosive assembly of FIG. 5.

The tubing cutter 48 as thus far described is essentially conventional, but includes a modification in this embodiment. The cartridge 56 may be assembled from separate parts in the housing 50,52 and held together by the housing. The housing portions themselves are held together by a snap ring 72, shown in detail in FIG. 6. In prior art embodiments of the cutter assembly 48, the snap ring 72 has been made of metal, e.g. steel. In this embodiment, the snap ring 72 is made of a material that releases the housing portions 50 and 52 from each other in the event that the cutter 48 is exposed to fire or other source of extreme heat. By allowing the housing 50, 52 to open in such events, the charge cartridge 56 is not exposed to high pressure as the explosive material 58, 60 burns or evaporates and less likely to detonate. The snap ring 72 may be made of any material which melts, disintegrates, burns, evaporates or otherwise looses it mechanical strength at an elevated temperature. In the present embodiment, the snap ring 72 was made of nylon that had a melting point of about 600 degrees Fahrenheit. Cutter assemblies like cutter 48 with a nylon snap ring 72 were tested in a standard bonfire test and found to have separated with the explosive 58, 60 burned away without detonation.

Figure 7:
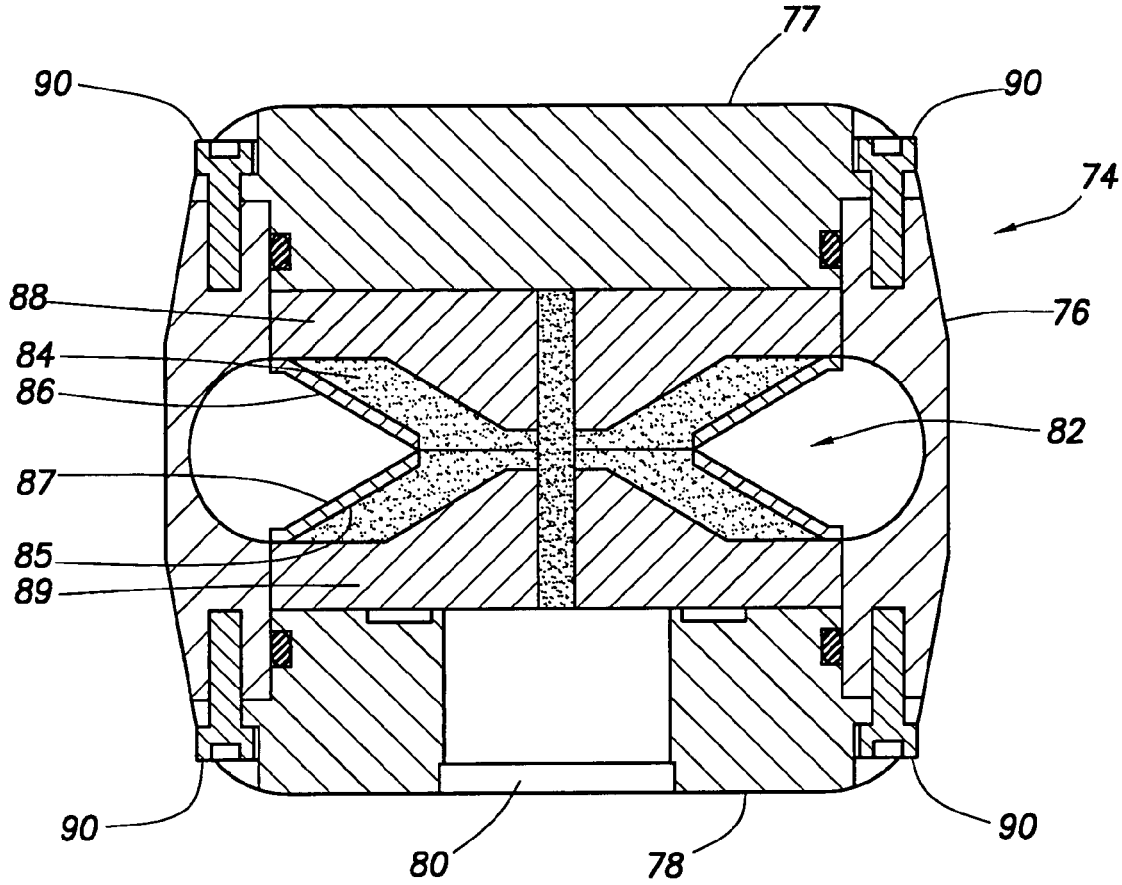
FIG. 7 is a cross sectional view of another circular explosive assembly which may be shipped in another embodiment of the invention.
Figure 10:
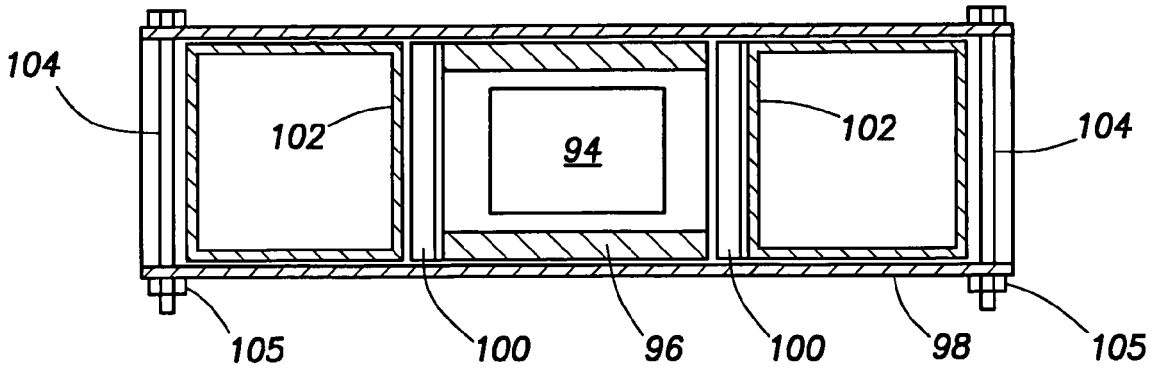
FIG. 10 is a cross sectional view of an embodiment of a tubing assembly useful in the embodiments of FIGS. 7 and 8.
Figure 8:
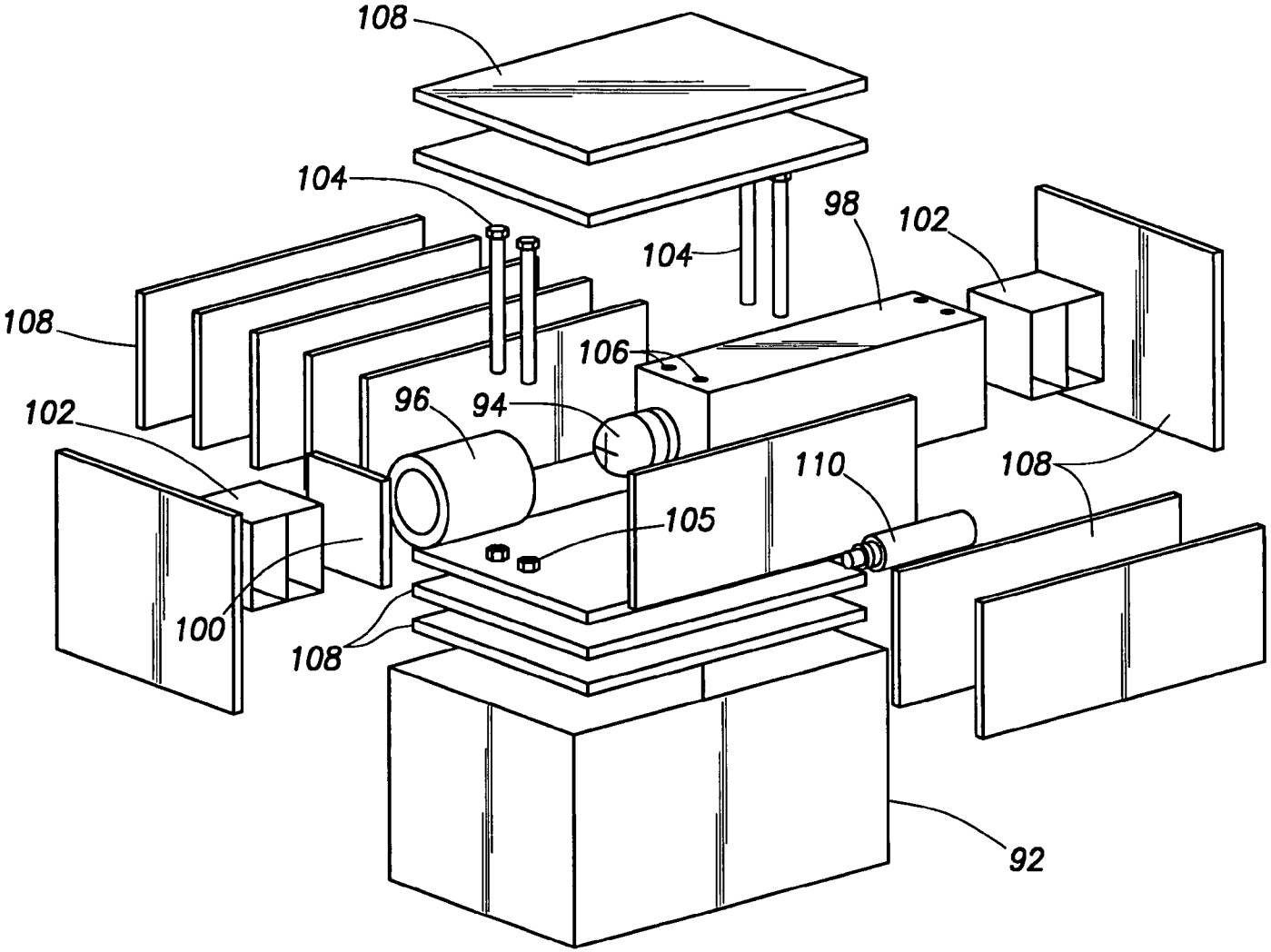
FIG. 8 is an exploded view of an embodiment of an explosive packing system suitable for one of the explosives shown in FIGS. 5 and 6.
Figure 9:
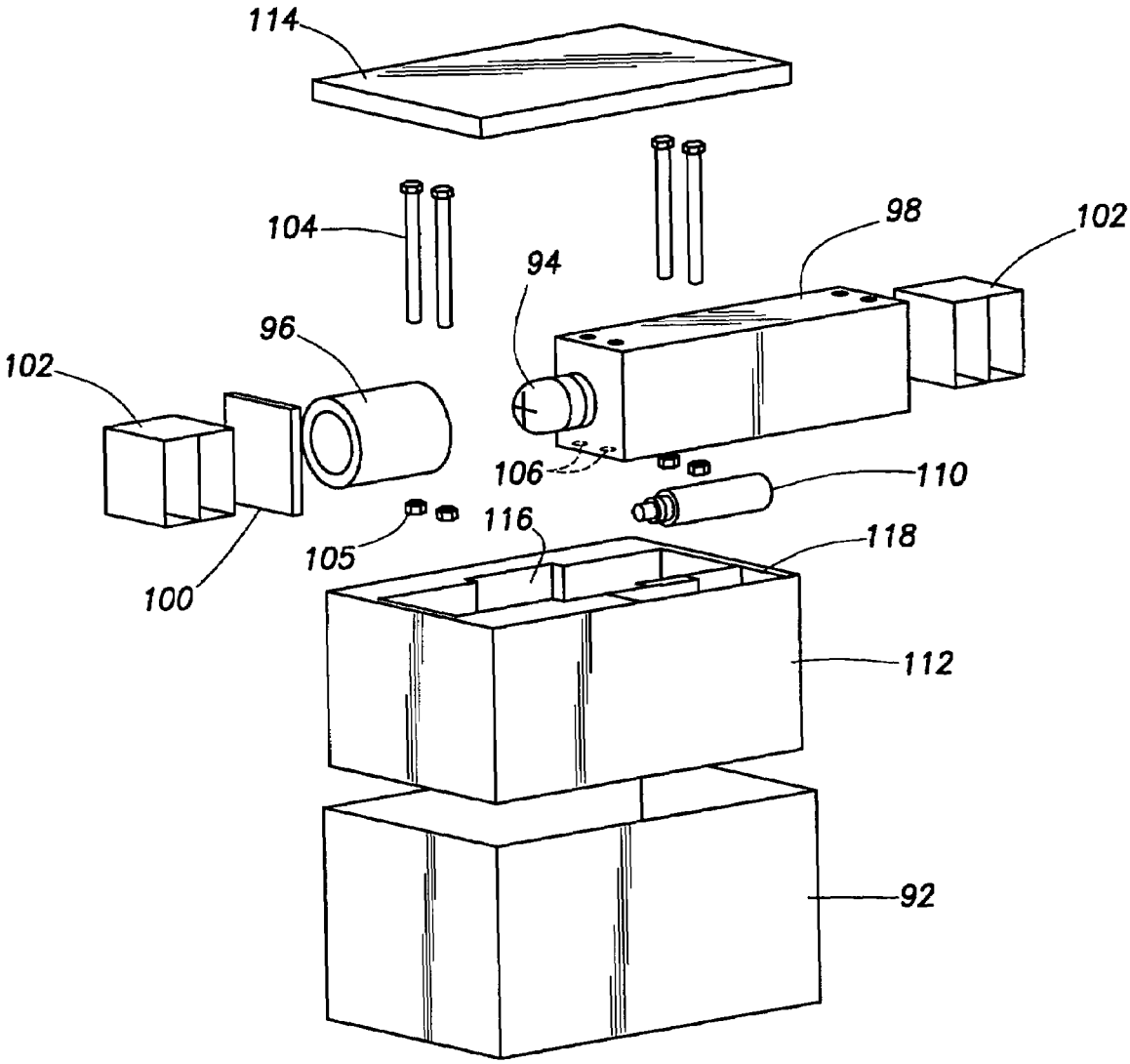
FIG. 9 is an exploded view of another embodiment of an explosive packing system suitable for one of the explosives shown in FIGS. 5 and 6.

FIG. 7 illustrates a second embodiment of a tubing cutter 74 which may be shipped in a packing system according to embodiments shown in FIGS. 8-10. The cutter 74 includes a housing formed by a generally cylindrical side portion 76 and end caps 77 and 78. End cap 78 includes an opening 80 for connection to a detonator. Carried within the housing 76-78 is a cutter cartridge 82 including explosive circular charges 84, 85, half liners 86, 87 and retainers 88, 89. The elements of tubing cutter 74 thus far described are conventional.

The cutter assembly 74 is held together by a set of screws or bolts 90, which connect the end caps 77, 78 to the center portion 76 of the housing. In this embodiment, the bolts 90 are made of a material, which releases the housing portions 76, 77, 78 from each other in the event that the cutter 74 is exposed to fire or other source of extreme heat. In tests of the invention, the bolts 90 were made of nylon and were found to allow the housing 76-78 to separate and prevent detonation of the explosive 84, 85 in a bonfire. The bolts 90 may be made of any material with sufficient mechanical strength at normal temperatures which melts, disintegrates, burns, evaporates or otherwise looses it mechanical strength at an elevated temperature.

FIG. 8 is an exploded view of an explosive packaging system in one embodiment of the invention. The entire packaging system is contained within a type 4G fiberboard box or container 92, which may be the same as the shipping container 14 of FIG. 1. The container 92 is preferably a type approved under UN regulations for shipping hazardous materials. A tubing cutter 94 is positioned at about the geometric center of the container 92 by a plurality of packing components. The cutter 94 is carried within a thick walled low density tube 96 which may be essentially identical to the tube 36 in the embodiments of FIGS. 1-4. The tube 96 in this embodiment is a rolled paper tube having a wall thickness of about 0.625 inch.

FIG. 10 illustrates the assembled arrangement of these parts is a cross sectional view. The cutter and tube 96 are carried in the center of a fragmentation shield 98. In this embodiment the shield 98 is a mild steel square cross section tube having a wall thickness of about 0.175 inch and outer cross sectional dimensions of 5 by 5 inches. It is preferred that the thickness be at least about 0.15 inch. The thickness may be increased if desired, however increased thickness will increase overall package weight and is not believed to provide a substantial advantage. For larger charges, the cross sectional dimensions may be greater than 5 by 5 inches as needed to hold the larger charges, but it is not necessary to increase the wall thickness beyond the preferred at least about 0.15 inch. In this disclosed embodiment, any spaces between the cutter 94, tube 96 and shield 98 are filled with packing paper or material such as KIM PAC to limit movement between parts. A foam rubber filter or fragment catcher 100 is placed against each end of the tube 96 within the shield 98. In this embodiment, each filter 100 has dimensions of about four by four by one inch. The thickness of the filter 100 is preferred to be at least 0.7 inch. The filters 100 operate in much the same way as the end caps 38 in the FIG. 2 embodiment.

A ballistic attenuator 102 is positioned against each of the filters 100 inside the shield 98. Each attenuator 102 may be a four-inch long section of four by four inch square tubing having a wall thickness of about 0.115 inch. It is preferred that the attenuator 102 wall thickness be at least about 0.1 inch. The attenuators 102 are turned so that one solid wall is against the filter 100. A pair of bolts 104 is positioned through a set of holes 106 near each end of the shield 98. The bolts 104 may be held in place by nuts 105. In this embodiment the bolts 104 were half-inch diameter, six inch long grade 8 bolts. The bolts 104 may be replaced with smooth rods and held in place by clevis pins, snap rings, or other fasteners as would be understood by those of skill in the art.

As noted above a larger shield 98 may be used for larger charges. For example the shield 98 may have cross sectional outer dimensions of six by six inches. In that case, the dimensions of the ballistic attenuator 102 may be increased proportionally to for example a five inch length of five by five inch square tubing. The size of the filter 100 would likewise be increased to dimensions of, for example, one inch by five inch by five inch. In each of these examples, the ballistic attenuator 102 and filter 100 fit loosely within the shield 98 to allow venting of gasses in the event of detonation or burning of an explosive carried in the shield 98.

The ballistic attenuators 102 and bolts 104 operate in essentially the same way as the partial tubes 44 and end covers 46 of the FIG. 2 embodiment. The attenuators 102 could have any of the various cross sectional shapes mentioned with respect to the partial tubes 44 and could be half of a length of square, round, hexagonal, etc. tubing. It is desirable that an attenuator 102 provides a surface to support the filters 100 and provide a substantial open space into which the walls of the attenuator may collapse to absorb kinetic energy and slow fragments that have impacted a filter 100 and the attenuator 102. A section of the rolled paper tubing used for partial tubes 44 could be used in place of the square metal tubing attenuators 102 of the embodiments of FIGS. 5-10.

The dividers 16 used in the embodiment of FIGS. 1 and 3 provide a fragmentation shield around the tubing assemblies 10 very similar to the fragmentation shield 98 of FIGS. 8-10. The laminated dividers used in FIG. 1 may be substituted for the metal shield 98 of FIGS. 8-10 if desired. However, since the tubing cutters 48 and 74 are designed to cut through a surrounding structure, it is preferred to use a metal fragmentation shield, which can absorb considerable energy as it stretches and expands. The thick walled tube 96 disrupts the circular jet from the tubing cutters 48 and 74 sufficiently that it does not cut through the shield 98.

A plurality of top, bottom, side and end fiberboard pads 108 are positioned between the completed fragmentation shield 98 assembly as shown in FIG. 10 and the container 92. The pads 108 are sized to position the assembly of FIG. 10 approximately in the center of the container 92. The pads 108 preferably have a thickness of at least about 0.4 inch. The pads 108 are preferably loosely fit between the fragmentation shield 98 and the container 92 so as to not restrict venting of gasses in the event of detonation or burning of the explosive material 58, 60, 84, 85.

Also shown in FIG. 8 is an explosive adapter 110 which may be used as the booster charge 70 shown in FIG. 5. The adapter 110 includes a steel or aluminum tube containing a piece of HMX, RDX, HNS or BRX detonating cord or some other explosive transfer assembly as understood by those of skill in the art. This adapter 110 may be included in the package by sizing and positioning the pads 108 to leave a space for the adapter 110.

FIG. 9 provides an exploded view of another embodiment of an explosives packaging system suitable for shipping tubing cutters. Parts that may be identical to parts shown in FIG. 8 are given the same reference numbers. In FIG. 9, the fiberboard spacers 108 of FIG. 8 have been replaced by a molded Styrofoam insert 112 and a Styrofoam top 114. The insert 112 has an interior space 116 sized and shaped to receive the fragmentation shield 98 assembly of FIG. 10. The insert 112 also has a smaller space 118 sized and shaped to receive the explosive adapter 110. The outer dimensions of insert 112 and top 114 are selected to fit within the standard fiberboard container 92. It is understood that the container 92 also has top flaps, which may be folded and taped for secure closure of the container 92.

The embodiments of FIGS. 5-10 operate in several ways to provide safe shipping of explosives in the event of an accidental detonation of one charge or in the event that a fire should occur in a warehouse, truck, airplane, etc. in which the package is located. In the illustrated embodiments, the cutter assembly 94 may be positioned with its central axis aligned with the central axis of the fragmentation shield 98. Upon detonation, the shaped charge produces a disk shaped jet that cuts through the wall of the tubing cutter 48 or 74 housing as in normal operation. Since the tubing cutters 48, 74 are designed to cut through heavy wall steel tubing or casing, the jet could be expected to also cut the relatively thin walled fragmentation shield 98. However, the tube 96 disrupts the jet and together with the available space, prevents the jet from cutting the fragmentation shield 98. The cutter housing, e.g. 50, 52 in FIG. 5, will break up into fragments upon detonation of the explosive. Many of the fragments will impact ballistic attenuators 102 which will deform and collapse, absorbing much of the energy. The bolts 104 prevent the attenuators 102 from leaving the shield 98. The bolts 104 also bend and absorb energy. With the dimensions given above, there is sufficient space between the attenuators 102 and the shield 98 to vent gas and avoid excessive pressure to work to avoid unintentional creation of a pipe bomb. The foam rubber filters 100 catch small fragments, which might otherwise bypass the attenuators 102 and leave the package with sufficient energy to cause injury.

In the event a packaged tubing cutter is exposed to a fire, much of the packaging materials will burn. When a cutter housing reaches an elevated temperature, the degradable connecting means, e.g. snap ring 72 or bolts 90, melt or otherwise lose physical strength so that the cutter assembly is free to separate in response to pressure within the housing. As a result, when the explosive material ignites, it burns but is not likely to detonate. During testing, this desirable result was achieved with tubing cutters comprising 39 grams of four different explosive materials, i.e. HMX, RDX, HNS and BRX.

In the above-described embodiments, the complete tubing cutter assemblies 48 and 74 of FIGS. 5 and 7 are shown packaged within the fragmentation shield 98 and then within the container 92. Such assemblies with 39 grams of explosive material were packaged as shown in both FIGS. 8 and 9 and subjected to standard testing. These tests included intentional detonation of a cutter assembly in one shipping package while the package was surrounded on all sides and top by other packaged cutter assemblies. In no case did detonation of one cutter cause any surrounding packaged cutters to detonate. The fragmentation shield bulged and split to some extent, but retained all fragments from the detonated cutter. A number of packaged cutters were also subjected to a bonfire test. All of the flammable packaging burned, the cutter assemblies came apart, and all explosive material was burned or evaporated. However, none of the explosives detonated. These tests demonstrated that the packaging embodiments described herein are safe and meet DOT 1.4S shipping regulations and UN test series 6 tests with 39 grams of explosive material in each package.

The present invention may be used for shipping tubing cutters that have more than 39 grams of explosive. The packaging may be scaled up dimensionally to accept larger charges of up to about 68 grams of explosive. For example the fragmentation shield 98 may be made from tubing having dimensions larger than five by five inches, but may have the same wall thickness of at least about 0.15 inch. The attenuators 102 may likewise be made from larger tubing, but should be about one-half inch smaller than the inner dimensions of shield 98 to allow for gas venting and should have a wall thickness of about 0.115 inch. However, as the packaging size is scaled up, its overall weight may exceed fifty pounds, which may not be desirable.

The packaging can also be used to ship unassembled tubing cutters. That is, the cutter cartridges 56, 82 may be packaged without the housings 50, 52 or 76-78 respectively. The charge halves 58 and 60 of the cutter cartridge 56 may be shipped in separate packages and then assembled on site to provide a larger explosive component. For example, if the packaging is approved for a 39 gram charge, two 39 gram half charges may be separately packaged and shipped and then assembled at the work site to form a casing cutter having a 78 gram explosive charge. As noted above, the packing system of the present invention could be scaled to safely ship a 78 gram charge, but the overall package weight would likely not be acceptable to many shipping companies.

Similarly, in some embodiments where it is determined to ship the tubing cutter in other than a completely assembled form, jet interrupters such as those employed in the earlier embodiments may be used in combination with the tubing cutter assembly. For example, a long thin bag of granular material could be laid in around the circumference of the tubing cutter explosive charge against the liner but inside the assembly. The assembly would have to be opened, the interrupter removed, and the assembly reclosed before firing, but during shipping the total packaging should provide that much more assurance against negative effects of an accidental explosion.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

What is claimed is:

1. An apparatus for packaging and shipping at least one shaped charge in a shipping container, comprising:

means for disrupting a jet during detonation of a shaped charge, means for containing fragments generated by detonation of a shaped charge, and means for positioning at least one shaped charge in the shipping container, wherein the shaped charge is a circular shaped charge assembled in a tubing cutter housing having at least two sections, further comprising a heat degradable fastener connecting the cutter housing sections, wherein the means for disrupting the jet comprises a low density thick walled tube surrounding the circular shaped charge, and wherein the means for containing fragments comprises:

a length of metal tubing surrounding the low density thick walled tube, a foam filter positioned at each end of the low density thick walled tube and within the metal tubing, a ballistic attenuator positioned against each foam filter and within the metal tubing, and retaining means attached to each end of the length of metal tubing to hold the low density thick walled tube, the filters and the ballistic attenuators within the metal tubing.

2. An apparatus according to claim 1, wherein the heat degradable fastener is a nylon split ring.

3. An apparatus according to claim 1, wherein the heat degradable fastener is a nylon bolt.

* * * * *